United States Patent [19]

Mace

[11] Patent Number: 4,699,380

[45] Date of Patent: Oct. 13, 1987

[54] FINGER GRIP INSERT FOR BOWLING BALL

[76] Inventor: Bobby Mace, 901 East Ave., Elyria, Ohio 44035

[21] Appl. No.: 752,590

[22] Filed: Jul. 8, 1985

[51] Int. Cl.[4] ..... A63B 37/00

[52] U.S. Cl. ..... 273/63 A

[58] Field of Search ..... 273/63 A, 65 EG; D21/233, 63 R, 63 B, 63 F, 63 G

[56] References Cited

U.S. PATENT DOCUMENTS

| | | | |
|---|---|---|---|
| D. 112,752 | 12/1938 | Douglas et al. | D29/20 |
| D. 149,510 | 5/1948 | Meyer | D29/20 |
| D. 170,260 | 8/1953 | Jones | D29/20 |
| 540,976 | 6/1895 | Grimes | 49/348 |
| 949,003 | 11/1909 | Marsh | 75/72 |
| 1,980,635 | 11/1934 | Rasmussen et al. | 2/21 |
| 2,661,951 | 12/1953 | Uhas | 273/63 A |
| 3,454,440 | 7/1969 | Vezirakis | 273/64 |
| 3,784,198 | 6/1974 | Bach | 273/63 A |
| 3,804,412 | 4/1974 | Chetirko | 273/63 A |
| 4,247,102 | 1/1981 | Seyler | 273/63 R |
| 4,289,312 | 9/1981 | Heimbigner | 273/63 A |
| 4,358,112 | 11/1982 | Straborny | 273/63 A |
| 4,381,863 | 5/1983 | Norman | 273/63 A |
| 4,416,456 | 11/1983 | Haimbigner | 273/63 A |
| 4,432,546 | 2/1984 | Allen | 273/63 A |
| 4,585,230 | 4/1986 | Martin | 273/63 A |

*Primary Examiner*—George J. Marlo

*Attorney, Agent, or Firm*—Donald A. Bergquist

[57] ABSTRACT

A finger grip insert for a bowling ball is formed of a resilient hollow body having an outer configuration adapted to be inserted into a finger hole of a bowling ball. The outer end of the insert is open to permit insertion of a bowler's finger into the interior of the hollow body. The interior of the body has a generally triangular shaped cross section defined by three spaced flat sides with respective concave portions of the body extending between respective pairs of the flat sides to allow the bowler's finger to stay in a relatively natural position while enhancing the feel and adding lift and power to the bowler's delivery as a result of the substantial finger to insert contact area provided by the finger grip insert.

10 Claims, 5 Drawing Figures

FINGER GRIP INSERT FOR BOWLING BALL

SUMMARY OF THE INVENTION

The present invention is directed to an improved finger grip insert for a bowling ball which is adapted to be inserted in a finger hole of a bowling ball to enhance bowler's grip of the ball during delivery.

An object of the invention is to provide an improved finger grip insert of the aforementioned type which enables a bowler to add lift and power to his delivery of the bowling ball. A further object is to provide an improved finger grip insert which permits a bowler to obtain a stronger feel of the bowling ball by increasing the contact area between the finger and the insert. An additional object of the invention is to provide an improved finger grip insert which allows a bowler's finger pads used for gripping to stay in a natural position rather than being flattened out as with a known finger grip insert while at the same time providing flat surfaces for guiding and reference with respect to the fingers during gripping and release.

These and other objects of the invention are attained by providing a finger grip insert for a bowling ball according to the invention, wherein the insert comprises a hollow body having an outer configuration adapted to be inserted in a finger hole of a bowling ball, at least one end of the hollow body being open to permit insertion of a finger into the interior of the hollow body, and wherein the interior of the body for receiving a bowler's finger has a generally triangular shaped cross section. This arrangement is advantageous in that it allows the finger pads of the bowler's digits to stay in a natural position rather than being flattened out while at the same time providing flat surfaces for guiding and reference of the fingers during gripping and release. Finger to insert contact area is also increased with the finger grip insert according to the present invention. As a result of these features, the bowler can attain a stronger feel and grip of the ball and add lift and power to his delivery.

According to a disclosed, preferred form of the invention the generally triangular shaped cross section of the interior of the hollow body of the finger grip insert is defined by three spaced flat sides on the interior of the body with respective concave portions of the body extending between respective pairs of the flat sides. The finger grip inserts are preferably inserted into the holes in a bowling ball such that the pads of a bowler's fingers inserted into the openings of the insert bodies will be adjacent the concave portions of the bodies located between the flat sides thereof while the back or fingernail on the bowler's fingers are adjacent the flat sides. This permits the pads of the bowler's fingers to stay in a relatively natural position along the curvature of the concave portions during gripping while the flat sides of the inserts increase the contact area between the inserts and fingers and serve as guides and references surfaces. The flat sides on respective sides of each finger pad increase the contact area during gripping and that adjacent the fingernail provides a reference surface for guiding the finger to aid in a consistent delivery and release of the bowling ball.

According to an additional feature of the present invention, a plurality of spaced ribs can be provided on one or more of the flat sides of the interior of the hollow body. Preferably, these ribs are provided on each of the flat sides of the inserts for the second and third fingers of the bowler's hand while the flat sides are left smooth on the finger grip insert for the bowler's thumb.

The hollow body of the finger grip insert of the invention is further characterized by provision of a bottom at the end thereof opposite the outer, open end. The bottom preferably has an inner contour which is generally form fitting with respect to the end of a bowler's finger inserted into the body. The insert body is preferably formed of a resilient material as by molding a silicone rubber, for example.

These and other objects, features and advantages of the present invention will become more apparent from the following description when taken in connection with the accompanying drawings, which show, for purposes of illustration only, one preferred embodiment in accordance with the present invention.

DETAILED DESCRIPTION OF PREFERRED EMBODIMENT

Figure 1:
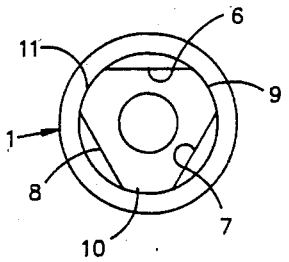
FIG. 1 is a top plan view of a finger grip insert according to a preferred form of the invention showing the generally triangular shaped cross section of the interior of the hollow insert body.
Figure 3:
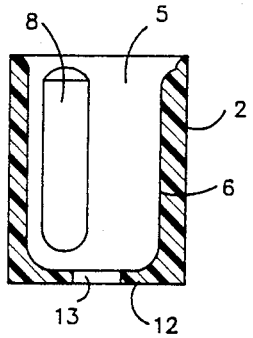
FIG. 3 is a sectional view of the finger grip insert of FIGS. 1 and 2 taken along the line III—III in FIG. 2.
Figure 2:
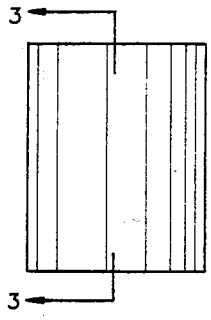
FIG. 2 is a side elevational view taken from the lower side of the finger grip insert shown in FIG. 1.

Referring now to the drawings, a finger grip insert 1 according to the invention is illustrated in FIGS. 1 through 3. The insert 1 comprises a hollow body 2 having an outer configuration adapted to be inserted in a finger hole 3 of a bowling ball 4. As shown in the drawings, the body 2 of the insert is cylindrical in form with the top or outer end of the body being open at 5 to permit insertion of a bowler's finger into the interior of the hollow body. The interior of the hollow body for receiving the bowler's finger has a generally triangular shaped cross section defined by three equiangularly spaced flat sides 6, 7 and 8 on the interior of the body. Respective concave portions 9, 10 and 11 of the body extend between respective pairs of the flat sides.

Figure 5:
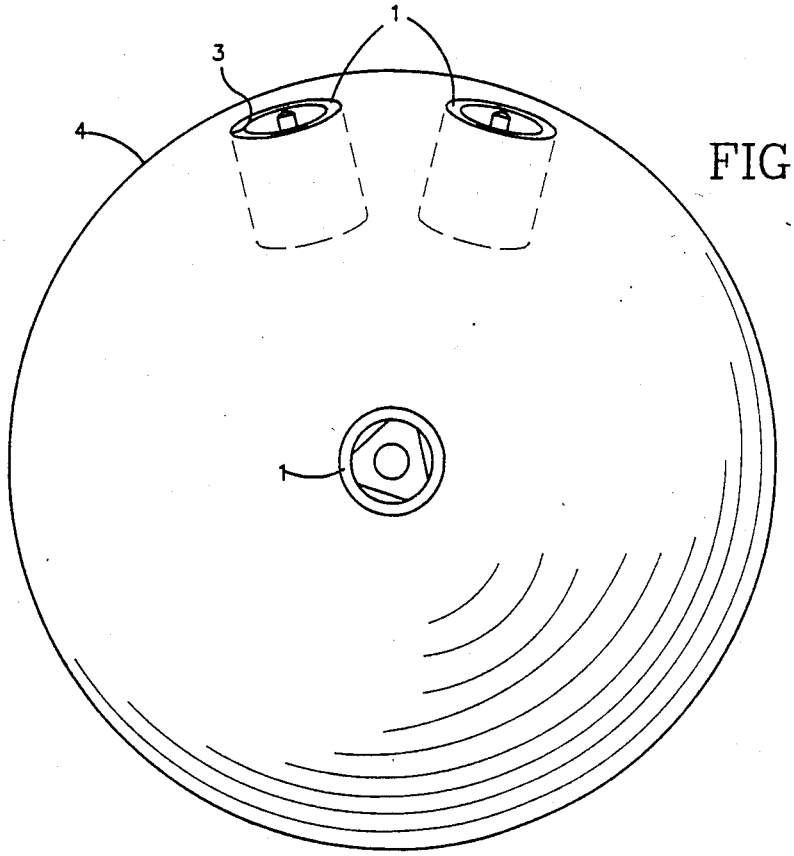
FIG. 5 is a top plan view of a bowling ball with three holes for a bowler's thumb, second and third fingers with finger grip inserts according to the invention being provided in each hole.

The hollow body 2 is preferably inserted into a finger hole 3 in a bowling ball 4 with the body being positioned in the hole such that the pad of a bowler's finger inserted into the opening of the body will be adjacent one of the concave portions or surfaces between a pair of the flat sides with the back or fingernail of the finger being adjacent one of the flat sides. As shown in FIG. 5 of the drawings, in the case of the thumb hole 3 shown in the center of the ball 4, for a right handed bowler, the flat sides 6, 7 and 8 of the generally triangular shaped cross section are located at the eleven o'clock, three o'clock and seven o'clock positions to achieve the desired orientation of the thumb with respect to the various surfaces of the finger grip insert as referred to above. Likewise, the two inserts inserted into the pair of holes in the bowling ball 4 for the second and third fingers are oriented so that the pads of the fingers will be adjacent concave portions or surfaces of the interior of the hollow body so that the finger pads stay in a natural position. Thus, the finger pads of the bowler's three fingers stay in a natural position rather than being flattened out while at the same time additional contact area is provided between the fingers and the insert by the flat sides of the hollow body on respective sides of each concave portion cooperating with a finger pad. The flat sides of the inserts adjacent to the backs of fingernails of the fingers also act as guides and references surfaces to aid in gripping and release of the bowling ball.

Figure 4:
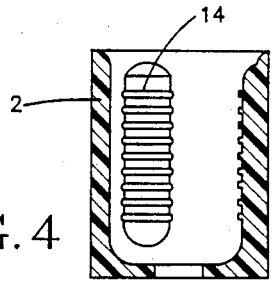
FIG. 4 is a sectional view of the finger grip insert similar to FIG. 3 illustrating an additional feature of the invention wherein ribs are provided on the flat sides of the interior of the insert body.

The hollow body 2 of the finger grip insert also preferably has a bottom 12 at the end of the insert opposite the open end 5. The bottom 12 has a central hole 13 therethrough as shown in FIGS. 1 and 3 with the bottom being concave with respect to the interior of the body so as to be generally form fitting with respect to the end of a bowler's finger inserted into the body. This form of a bottom surface also facilitates positioning of the bowler's finger within the bowling ball. In the form of the invention illustrated in FIGS. 1 through 3, the flat sides 6, 7 and 8 are smooth flat surfaces. However, as shown in FIG. 4, a plurality of spaced, transverse ribs 14 can be provided on the flat sides of the interior of the hollow body to increase the bowler's grip and feel of the ball. In practice, it has been found that the use of a plurality of spaced ribs 14 on the flat sides of the interior of the body are particularly useful for enhancing the gripping of the second and third fingers on the bowler's hand. However, it is generally preferred that the flat surfaces on the interior of the hollow body be smooth in the insert for the bowler's thumb. Of course, this is a matter of preference and the flat surfaces for the inserts for all three fingers may be smooth or ribbed or any combination thereof.

The finger grip insert 1 is preferably formed by molding the hollow body 2 of a resilient material such as silicone rubber. As an example, the outer diameter of the finger grip insert can be 63/64 of an inch with the inside diameter of the hollow body 2 being selected within the range of 17/32 to 29/32 inch for the concave portions or surfaces 9, 10 and 11 of the hollow body. The three equally spaced flat sides 6, 7 and 8 are positioned equiangularly about the inside of the hollow body 2. The spaced flats have a depth of 0.030 inch with respect to the circle passing through the concave portions or surfaces. The width of the three equally spaced flat sides may be on the order of 11/32 inch with the length or height of the flat sides extending over most of the length or depth of the opening 5 defined by the body 2. That is, the flat sides extend to a location close to the bottom 12 of the body 2. Also, relatively narrow flat surfaces may be provided on both sides of the respective flat sides 6, 7 and 8 as a transition between the flat sides and the curved, circular portions of the concave surfaces extending between the flat sides. These narrow flat surfaces may be 3/32 inch across, for example and can extend the same length as the relatively wide flat sides 6, 7 and 8 while being inclined-at a slight angle with respect to the plane of their associated flat side in the direction to their adjacent circular surface. The bottom 12 of the body 2 can be formed with a radius of curvature of ½ inch. The transverse ribs 14, if any, provided on the flat sides 6, 7 and 8 may project outwardly 0.010 inch from their associated flat side and be spaced 3/32 inch apart. The length of the insert can be approximately 1-7/32 inch. Of course, these dimensions are not intended to be limiting but are presented only by way of example and would necessarily vary, at least in part, depending upon the size of a bowler's fingers.

While I have shown and described only one embodiment in accordance with the present invention, it is understood that the same is not limited thereto, but is susceptible to numerous changes and modifications as known to those skilled in the art. Therefore, I do not wish to be limited to the details shown and described herein, but intend to cover all such changes and modifications as are encompassed by the scope of the appended claims.

I claim:

1. A finger grip insert for a bowling ball, said insert comprising a hollow body having an outer configuration adapted to be inserted in a finger hole of a bowling ball, at least one end of said hollow body being open to permit insertion of a bowler's finger into the interior of said hollow body, wherein said interior of the hollow body for receiving a bowler's finger has a generally triangular shaped cross section including three spaced flat sides on the interior of said body and respective concave portions of said body which extend between respective pairs of said flat sides, and wherein said hollow body is adapted to be inserted into a finger hole in a bowling ball with the hollow body being positioned in said hole such that the pad of a bowler's finger inserted into the opening of said hollow body will be adjacent one of said concave portions between a pair of said flat sides with the fingernail on the bowler's finger being adjacent the other of said three flat sides to provide a reference surface for guiding the finger to aid in a consistent delivery and release of the bowling ball.

2. A finger grip insert according to claim 1, wherein a plurality of spaced ribs are provided on at least one of said flat sides on the interior of said body.

3. A finger grip insert according to claim 1, wherein the surfaces of said flat sides are smooth.

4. A finger grip insert according to claim 1, wherein said hollow body has a bottom at an end thereof opposite said open end.

5. A finger grip insert according to claim 4, wherein said bottom is concave with respect to the interior of said body so as to be form fitting with respect to the end of a bowler's finger inserted into said body.

6. A finger grip insert according to claim 1, wherein said body is formed of a resilient material.

7. A finger grip insert according to claim 6, wherein said resilient material is silicone rubber.

8. A finger grip insert according to claim 1, wherein the interior of the hollow body has a generally equilateral triangular shaped cross section.

9. A finger grip insert for a bowling ball, said insert comprising a resilient hollow body having a generally cylindrical outer configuration adapted to be inserted in a finger hole of a bowling ball, at least one end of said hollow body being open to permit insertion of a finger into the interior of said hollow body, the interior of the body for receiving a bowler's finger having a generally triangular shaped cross section defined by three spaced flat sides on the interior of said body with respect to concave portions of said body extending between respective pairs of said flat sides, and wherein said hollow body has a bottom at an end thereof opposite said open end, said bottom having a contour which is form fitting with respect to the end of a bowler's finger inserted into said hollow body.

10. A finger grip insert according to claim 9, wherein the interior of the hollow body has a generally equilateral triangular shaped cross section.

* * * * *